United States Patent [19]

Capdeboscq

[11] Patent Number: 5,057,068

[45] Date of Patent: Oct. 15, 1991

[54] DEVICE FOR SIDEWISE SHIFTING OF A TOOL IN A SLOTTING STATION CONTAINED WITHIN A MACHINE PROCESSING SHEET-LIKE WORKPIECES

[75] Inventor: Bernard Capdeboscq, Saint-Just-Chaleyssin, France

[73] Assignee: SA Martin, France

[21] Appl. No.: 483,623

[22] Filed: Feb. 23, 1990

[30] Foreign Application Priority Data

Feb. 24, 1988 [FR] France ..... 8902730

[51] Int. Cl.[5] ..... B31B 1/20; B31B 1/25; B26D 7/26

[52] U.S. Cl. ..... 493/355; 493/366; 493/367; 493/402; 493/473; 493/475; 493/478; 493/479; 83/72; 83/425.4; 83/508.3

[58] Field of Search ..... 493/355, 361, 362, 363, 493/364, 365, 366, 367, 369, 370, 396, 401, 402, 471, 473, 475, 478, 479; 83/72, 425.4, 508.3

[56] References Cited

U.S. PATENT DOCUMENTS

| | | | |
|---|---|---|---|
| 2,961,015 | 11/1960 | Randall | 83/508.3 |
| 4,072,887 | 2/1978 | Buschmann et al. | 83/425.4 |
| 4,077,291 | 3/1978 | Obenshain | 83/508.3 |
| 4,684,360 | 8/1987 | Tokuno et al. | 493/367 |
| 4,690,022 | 9/1987 | Takahashi | 493/367 |
| 4,781,668 | 11/1988 | Mowry | 493/366 |
| 4,836,458 | 6/1989 | Cavagna | 83/425.4 |

*Primary Examiner*—William E. Terrell

*Attorney, Agent, or Firm*—Hill, Van Santen, Steadman & Simpson

[57] ABSTRACT

The invention is directed to a device for sidewise shifting and positioning of a tool in a slotting station situated within a machine used for processing sheet-like workpieces. The station includes a creasing tool, a counter tool, which are mounted on a first pair of vertical, arranged horizontally extending shafts, a slotting tool and counterpart, both fitted on a second pair of shafts arranged downstream of the first pair, a master plate being held in the transfer direction of the workpiece by two crosswise shafts, one of which is for guiding and the other is for shifting the master plate on the guiding shift, the plate having an arrangement for gripping each of the upper tools of the pairs of tools, which arrangement includes an arrangement for laterally shifting the arrangement for one of the two tools relative to the master plate while holding the tool simultaneously fully parallel to the master plate.

8 Claims, 3 Drawing Sheets

DEVICE FOR SIDEWISE SHIFTING OF A TOOL IN A SLOTTING STATION CONTAINED WITHIN A MACHINE PROCESSING SHEET-LIKE WORKPIECES

BACKGROUND OF THE INVENTION

The present invention is directed to a device designed for the sidewise shifting of a tool on a rotary shaft in a slotting station located within a machine used for converting thick, solid or corrugated board into boxes. For a better understanding of the invention, it should be added that as a sheet is transferred along a given direction, the station along this direction of transfer will, first, accomplish a creasing operation to prepare parallel lines for ultimate folding and, then, provide a slotting operation on both the upstream and downstream edges of the sheet or plate, which edges are normally situated on the extensions of the previously imprinted creasing lines. The slots will define the future box flaps. In order to insure a regular accomplishment of this process, a driving operation is frequently interposed or sandwiched between the two above-mentioned stations performing the two above-mentioned operations.

For the purposes of this operation, the plate-like or sheet-like workpieces travel through pairs of circular tools consisting each of an active tool and a counterpart fitted on an upper and lower horizontal shaft arranged perpendicular to the travelling direction of the workpieces. The station, thus, usually includes three pairs of vertical shafts, one for the creasing at the inlet, a center driving section and a slotting section at the outlet of the station. Moreover, this station will include a mechanism enabling the sidewise shifting of the assembly of the three tool pairs situated along a common line that extends parallel to the travelling direction of the workpiece, which mechanism is designed to allow the holding of the slotting tools axially aligned with the creasing tools during the setting of the size of the boxes to be produced.

Each of these mechanisms essentially consist of a master plate for the three upper tools of the three pairs of tools and a master plate for the lower three tools of the three pairs of tools. These plates are provided on their periphery with means for guiding the sidewise positioning of the tools situated on their respective shafts. Such guide means can, for example, include an arch-like or arcuate slot with a fork effect which engages in a crosswise groove of the circular tool, which groove enables the tool to be able to turn freely by means of the driving shaft. Another guiding means consists of a broader arch-like slot completed with dogs or sliding shoes which both engage in the crosswise groove of the tool. Other ways of realization are also possible, for example the use of a salient wearing disk turning with the tool and held between two wearing sliding shoes situated on either side of the plate.

Every master plate is held vertically in the travelling direction of the workpieces by at least two shafts, one of which is a smooth guiding shaft passing through the fork of the plate which is completed by an upper and lower guiding box being in contact with this one shaft. The second shaft is a threaded shaft passing through a ball-nut permanently fitted on the master plate. When, owing to an electric motor, the threaded shaft acting on the ball-nut of the plate is rotated, the plate will be shifted sidewise, i.e., to the right or the left side, along the axis of the threaded shaft with the amount of shifting being perfectly vertical or perpendicular to the travelling direction of the workpieces. This plate can, then, simultaneously move the upper three tools, which will remain along a common line. A similar lower device will move the three lower counterpart tools.

In a slotting station comprising six parallel rows of tools, it is evident that the upper device for setting the position of the tools requires at least on common guiding shaft and three threaded shafts for setting the position of the tools if the blanks are symmetrical with regard to the median axis of the station. If the blanks are not symmetrical, then six individual shafts, i.e., three from each side, are required. The lower device will require an identical number of shafts.

It has further proven useful to shift sidewise over a short distance the creasing tool with regard to the slotting tool in such a way that the future fold appears a little closer to the one flap than to the other. In fact, during the folding operation of a box, a movement occurs when the first flap is to be folded inward in between the three others, which are still in a vertical position. In this case, if the folds are exactly centered with regard to the slots, the operation becomes difficult when just one of the adjacent flaps is slightly offset. On the contrary, if the fold is to happen exactly on the extension of the adjacent flap edge, the creasing action, being thereby effectuated on the extension of a side of the slot, the width of this same slot will then create, during the folding operation, a security margin on either side.

A first solution would consist in providing that only the upper part of every triple tool arrangement belonging to the same line, a first device for positioning only the creasing tool, as well as a second device for positioning the slotting tool and a driving tool would be provided. This solution might involve the doubling of the number of guiding shafts and threaded shafts bringing about a greater weight for the station and, thus, increasing the cost with a slight correction as compared to the initial shifts.

The presently used solution consists in dismantling the active part of the creasing tool from the body fitted on the shaft, and in fitting it again by laterally superimposing one or several shims having the shape of the crosswise disk with standard thickness. This solution would, however, involve a very long setting-up time when changing production from one box type to another. In fact, after every test run, the operator would need to dismantle the appropriate tool for changing the shims and then to continue a test run until the final results proved satisfactory.

SUMMARY OF THE INVENTION

The purpose of the present invention is to provide a device enabling accurate and easy sidewise shifting of the creasing tool with regard to the operating line of the corresponding slotting tool or of the slotting tool with regard to the creasing tool. Such a device should enable the shifting of a considerable mass over a very short distance in a jerkless fashion in such a way as to enable smooth stopping in the chosen position. Conspicuously, though, this device should be kept in a simple conception to insure its sturdiness and, hence, its reliability.

To accomplish these goals, the invention is directed to an improvement in a device for shifting the lateral position of the tools in a slotting station situated within a machine processing sheet-like workpieces, said station having at least a creasing tool and counterpart fitted in a corresponding fashion on a first vertical pair of parallel horizontal shafts arranged to extend perpendicular to a conveying direction of the sheet-like workpieces through said machine, slotting tools and appropriate counterparts fitted on another pair of shafts arranged downstream in a similar fashion to the first-named pair, as well as means for simultaneous sidewise positioning of all upper tools situated in a common line extending parallel to the conveying direction of the workpieces, said means consisting essentially of a master plate held in a vertical position and oriented along the conveying direction for the workpiece by at least first and second crosswise shafts, said first crosswise shaft being a guiding shaft and the second shaft being provided with threads which will engage threads of the master plate to cause a crosswise shifting motion of the master plate as the threaded shaft is rotated, said master shaft being provided on its periphery with engagement means laterally guiding of the respective tools. The improvements comprise adjustment means for mounting one of the engagement means for the selected one of the tools on the master plate, said adjustable means including a secondary plate and mechanical means allowing the mounting of the secondary plate on the master plate in selected laterally offset positions extending at right angles to the master plate, said mechanical means holding the secondary plate parallel to said master plate.

In a first solution, the mechanical means will include a horizontal spindle which is mounted on the master plate to extend at right angles to the plane of said plate, a metal block permanently connected on the secondary plate, a first bore for receiving said spindle extending through said block and secondary plate at a right angle to the plane of said secondary plate for receiving said spindle. The block also includes a vertical aperture crossing the first bore at right angles and the spindle has a crosswise aperture aligned with this aperture, a vertical rod has a lower pivot or pin which is engaged in the crosswise aperture of the spindle and the vertical rod has an upper part, which terminates in a head and is held rotationally movable on the master plate by a support and a cylindrical portion which is off-center relative to the lower pivot and the upper part. Thus, rotation of the vertical rod due to the eccentric portion will cause the block and secondary plate to move along the axis of the spindle to cause the tool guided by the secondary plate to be shifted laterally relative to the remaining tools guided by the master plate. This conception has shown the usefulness of providing a vertical rod's head at its upper end with a small bar passing through it. This small bar can be pushed downward by a pull-back means or spring means in order to have the lower end of the bar engaged in apertures on the upper side of the support. This bar on its upper end has a knob which allows a lifting of the bar against the action of a pull-back means. In this way, the small bar allows an interlocking of the head's angular position in a predetermined position with regard to the support and, thus, provides locking of a lateral position of the secondary plate with regard to the master plate.

In another embodiment of the solution, the mechanical means may comprise a horizontal spindle mounted on the master plate or the secondary plate and slidably received in a bore in the other of said plates, at least one screw extending at right angles to the master plate and the secondary plate, said screw having either a threaded or helical part and a smooth part so that the screw can be mounted in either the master plate or the secondary plate for rotation and be threaded in the other of said plates. Thus, rotating of the screw will cause the two plates to move together or apart, depending on the direction of rotation.

In an appropriate fashion, the periphery of the spindle head is provided with an adequate number of apertures allowing a ball detent to engage one of the apertures to lock the screw in a selected angular position to insure the desired lateral spacing between the secondary plate and the master plate.

Other advantages and features of the invention will be readily apparent from the following description of the preferred embodiments, the drawings and claims.

BRIEF DESCRIPTION OF THE DRAWINGS

FIGS. *2a–2c* are partial cross sectional views taken in the plane of II of FIG. 1 to illustrate the shifting of one plate relative to the other due to rotation of a vertical rod having an offset portion in accordance with the embodiment of FIG. 1.

DESCRIPTION OF THE PREFERRED EMBODIMENTS

Figure 1:
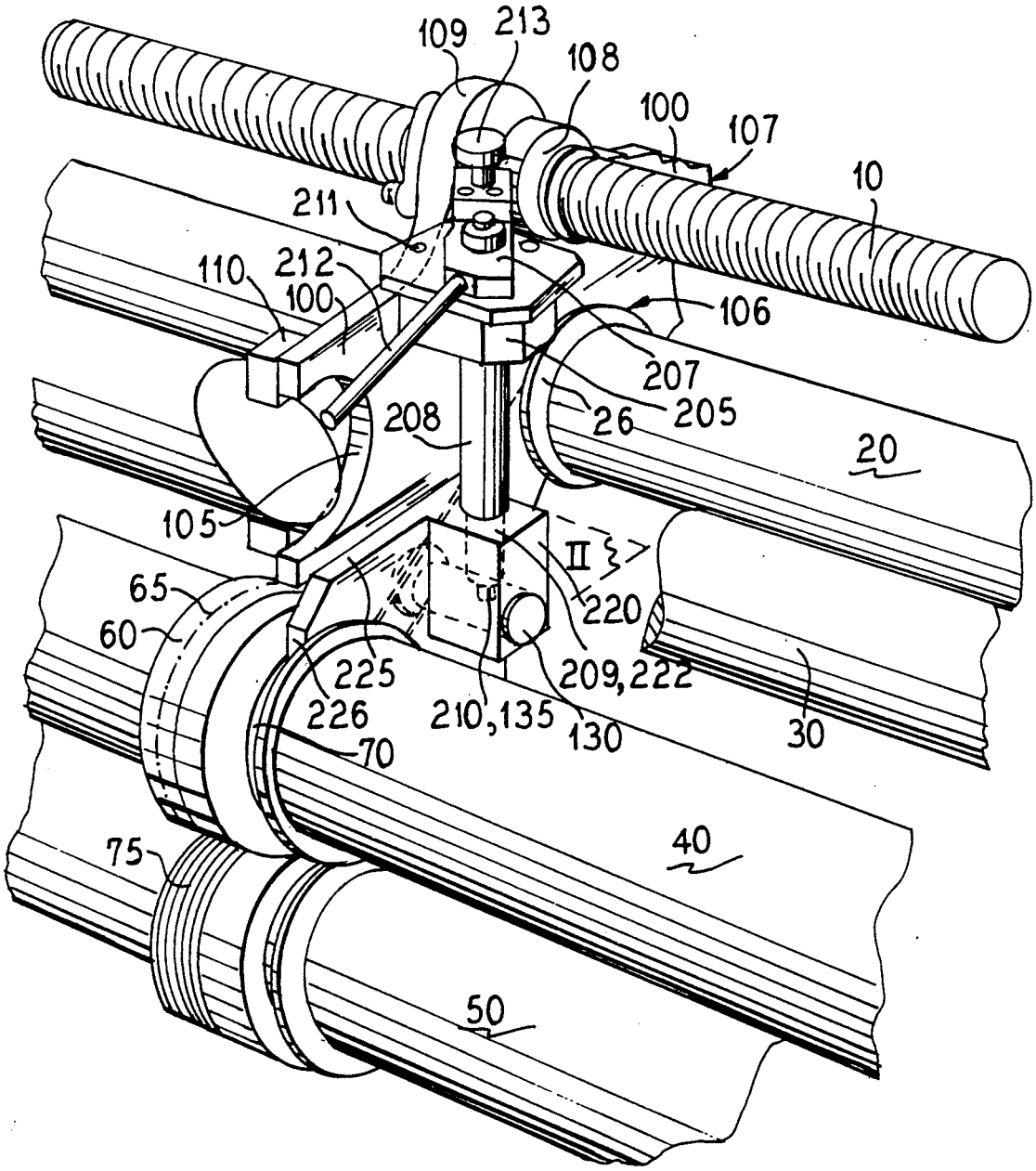
FIG. 1 is a perspective view of a first embodiment of the present invention.
Figure 2A:
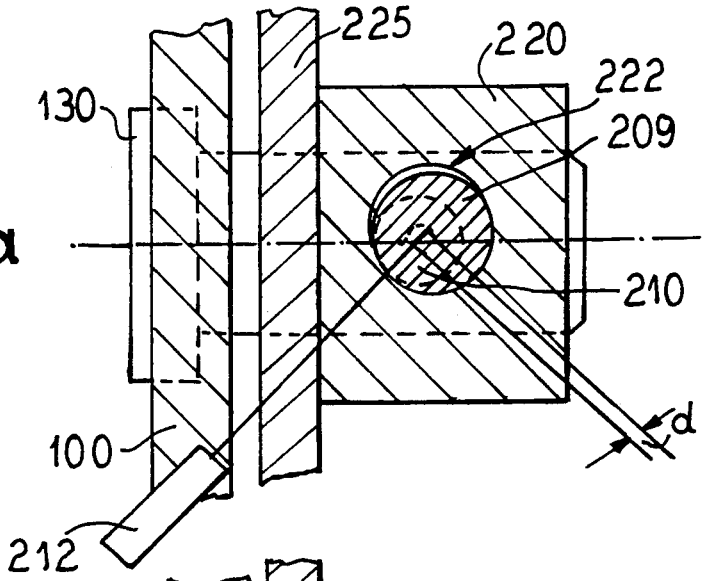
Figure 2B:
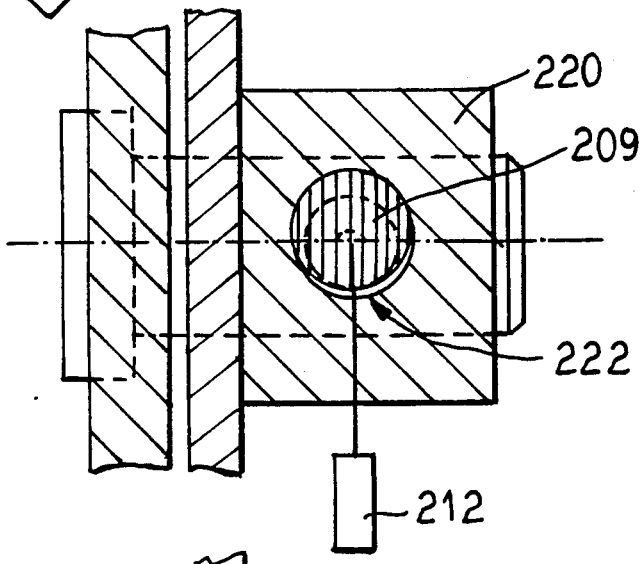
Figure 2C:
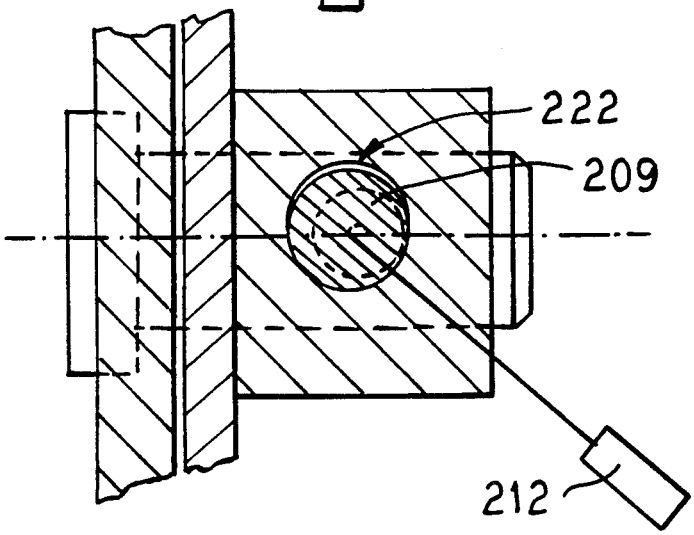

The principles of the present invention are particularly useful in the device illustrated in FIG. 1. As shown, a creasing tool 60 is mounted on a shaft 40 with a counterpart 75 fitted on a shaft 50. Downstream of the shafts 40 and 50, which is to the right-hand side, is an upper driving tool 26, which is mounted on a shaft 20. A counterpart for the upper driving tool, as well as conventional slotting tools have been left out of the present drawing for the purpose of illustration.

The device of the present invention includes a master plate 100 for checking the sidewise position of the upper tools and is held vertically in the travelling direction or the direction of advance of the workpiece by two shafts, including a guiding shaft 30 and a threaded shaft 10. For a better understanding in FIG. 1, portions of the guiding shaft 30 have been removed, but ordinarily this shaft is made up of one smooth, chromium plated piece in order to allow the guide 110 of a guiding fork 105 of the master plate 100 to slide easily along this shaft. Two ball-nuts 108 are mounted on either side of a nut 109 of the master plate 100. The threaded shaft 10 is threaded across the two ball-nuts 108 which impart the master plate 100 with a vertical position, which is in a plane extending at right angles to the axis of the threaded shaft 10. Moreover, when the threaded shaft 10 rotates in one or the other directions, the ball-nuts impart to the shaft 100 a corresponding shifting motion toward the right or left-hand side along the axis of the shaft 10.

The periphery of the master plate 100 is provided with several arch-like slots which form a fork effect and the slots will engage in circular grooves of corresponding tools. A fork 107 of the slotting tool, as well as a fork 106 engaged in the upper driving tool, are shown in FIG. 1. In the device according to the invention, the fork of a master plate 100 opposite the creasing tool 60 has been replaced with an enlarged part which does not engage the creasing tool. In its place, a groove 70 of the creasing tool is engaged by a fork 226 belonging to a secondary plate 225. This secondary plate 225 is carried with an integral block 220 received on a spindle 130.

The spindle 130, in turn, is mounted to extend orthogonally or at right angles to the plane of the master plate 100 opposite the creasing tool 60.

The spindle 130 is provided with a crosswise vertical aperture 135. The block 220 has an aperture 222 which extends at right angles to the bore receiving the spindle 130 and which is approximately aligned with the aperture 135. The master plate 100, at a position above the block 220, has a support 205. This support 205 holds an upper section of a vertical rod 208 which has a pin or pivot point 210 which is at the lower end and is engaged in the aperture 135 of the spindle. The rod 208 has a portion or part 209 which is received in the aperture 222 of the block 220. The vertical rod 208, at its upper end, is provided with a head 207 which has a handle 212. The head 207 has an extension which receives a small, vertically extending bar or rod having an upper knob 213. This extension is provided with a biasing means, such as a spring, to push the bar downward so that, for instance, the spring may act between the lower shoulder of the small bar and an upper side of a recess of the housing of the extension to urge the bar downward The bar is, thus, able to engage interlocking apertures 211 which are provided on an upper surface of the support 205 and, thus, interlock the angular position of the head 207 with regard to the support 205.

Interaction of the cylindrical part 209 of the rod 208 which is received in the aperture 222 of the block 220 can be gathered more easily from FIGS. *2a, 2b* and *2c*. As illustrated, the center of the pivot or pin portion 210, which is engaged in the spindle 130, which is itself permanently secured on the master plate 100. As illustrated, the secondary plate 225 will slide along the spindle and the plate is connected with the block 220. The cylindrical part 209 is eccentrically situated at a distance d from a vertical axis of the pin or pivot 210 and from the vertical rod 208. The cross section of the aperture 222 of the block 220 is not exactly a circular configuration but consists of two half-circles with a radius slightly exceeding the one of the cylindrical part 209. The half-circles form an oval having a major axis extending parallel to the secondary plate, with the distance of the major axis being approximately d greater than a minor axis which extends at a right angle to the plate 100. As illustrated in FIG. *2a*, the lower edge of the aperture 222 corresponds to the lower position of the cylindrical part 209 when the handle 212 is turned fully through a clockwise position, illustrated in FIG. *2a*, or fully turned through a counterclockwise position, as illustrated in FIGS. *2c*. Reciprocally, the upper edge of the aperture 222 corresponds to the position of the cylindrical part 209 when the lever is in a parallel position with regard to the secondary plate 225, as shown in FIG. *2b*.

As may be noticed easily from FIGS. 1 and *2a–2c*, any action of the handle 212 after lifting the knob 213 results in a rotation of the vertical rod 210 around its center of rotation formed by the pin 210 and within a support 205. This rotation of the rod 208 causes a rotation of the cylindrical part 209 to exert a pushing effect on one or the other side of the block 220, thereby shifting the secondary plate 225 with regard to the master plate 100. The operator usually accomplishes this revolution as far as a position enabling him to re-engage the small bar in a new aperture 211 of the support 205. This sidewise shift of the secondary plate 222 causes a similar shift of the creasing tool 60 on account of the engagement of the fork 226 in the groove 70. As the counterpart 75 is sufficiently broad with respect to this slight shift imparted, there is no necessity to reconsider its position.

Figure 3:
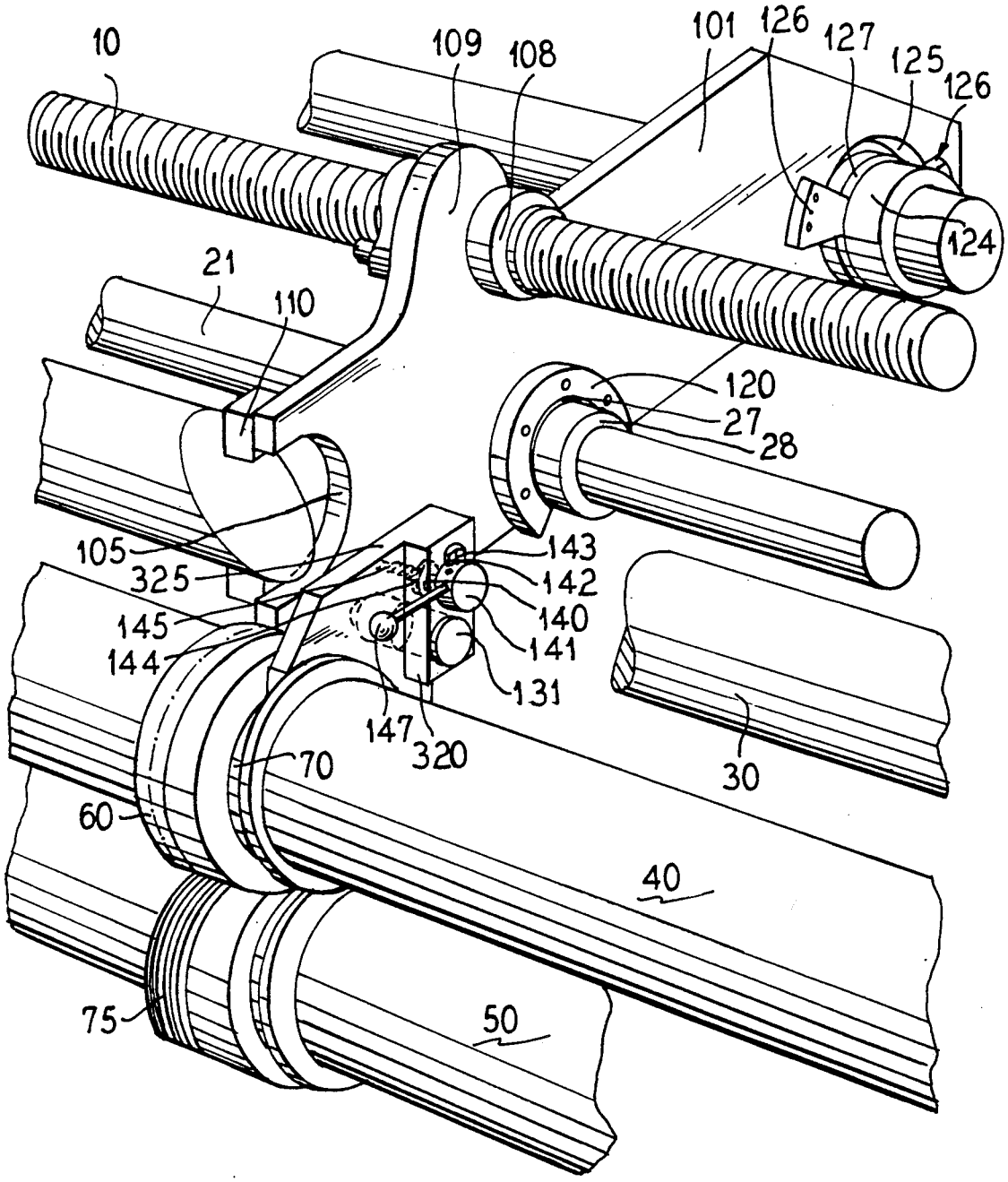
FIG. 3 is a perspective view of a second embodiment in accordance with the present invention.

A second embodiment of the invention is illustrated in FIG. 3. The part similar to those described above have identical references, and it is also gathered, especially, that a creasing tool 60 is carried by the shaft 40 and its counterpart 75 is, itself, carried by the shaft 50. A master plate 101 is held in a vertical plane that extends parallel to the direction of travel of the sheet-like workpieces and with regard to a guiding shaft 30 and a threaded shaft 10 acting on the nut 109 through the two ball-nuts 108.

FIG. 3 also shows, though not limitatively, two other ways for achieving sidewise guiding of the tool with the master plate 101, for example, the guiding piece of the drive tool 28 and the slotting tool 124. The tool 28 is actually a cylindrical salient disk 27 held between two wearing sliding shoes 120, which are situated on either side of the plate 101. The tool 124 has a circular crosswise groove 127 similar to the groove 70 of the tool 60. However, in this case, the arch-like slot 125 of the master plate 101 has been increased in size so that two driving dogs 126 fitted on the periphery of the slot 125 extend into the groove 127 to engage the tool 124. As may be easily gathered, the advantage of this other guiding mode results in a replaceability of the parts subject to operational wear.

In this mode of realization, the secondary plate 325 is connected to the master plate 101 by means of a spindle 131 and a screw which extends parallel to the spindle 131 and both extend horizontally.

As shown by the illustration, the spindle 131 is fitted crosswise and extends orthogonally in a bore of the secondary plate 325 where it is held by a squeezing action or else by welding and from where it penetrates into an aperture correspondingly arranged in the master plate 101 within which it has the possibility to slide to and from. It is also possible to envision an inversed arrangement, i.e., a spindle 131 fitted permanently on the master plate, as well as the secondary plate 325 sliding, in this case, along this spindle in a manner similar to the arrangement of FIG. 1.

The screw, as illustrated in FIG. 3, has a head 141 adjacent a smooth part 140 and has a threaded part 145. In the embodiment of FIG. 3, the screw is mounted on the secondary plate 325 with the smooth part being received in a bore of the plate so that the screw may be threaded into the master plate 101. To maintain the screw in position, a washer or shoulder 144 is provided opposite the head 140 to entrap the screw in the secondary plate. The threaded part 145 of the screw will engage a threaded aperture provided in the master plate 101. The head 141, moreover, on its periphery, is provided with a handle 147 and has an appropriate number of semi-spherical apertures or depressions. Close to the head 141, a spring detent is mounted and has a spring, such as 143 that pushes a small ball 142 out of its seat and into engagement with one of the apertures of the head 141. This device, with the aperture and ball, thus, allows an indication of the angular position of the screw.

It becomes, thus, obvious that, owing to the action exerted by the handle 147, it is possible to turn the screw which, with the coaction of the threaded part 145 within the threaded aperture in master plate 101, will cause shifting or relative movement of the secondary plate 325 with the master plate. Depending on the direction of rotation, the two plates will move closer together or further apart. The plates will move and maintain their parallel arrangement due to the large diameter of the spindle 131 and the increased thickness of the secondary plate at the position where the spindle 131 is mounted. It is also possible to envision a helical ramp substituted for the threaded part 145, as well as an appropriate arrangement of the aperture in order to improve the continuity of the translational movement.

Obviously, it is also possible to envision a reverse arrangement for the screw in which the smooth part 140 is held within the master plate 101 and the threaded part 145 engages in the threaded aperture of the secondary plate 325. However, such an arrangement will still operate in the same manner.

In another version, the spindle 131 is replaced by a second screw identical to the first-mentioned screw and the two parallel-extending screws will be threaded in two parallel-extending apertures or bores. In addition, the two screws are coupled together so that both screws will rotate together in the same direction with the first screw driving the second screw. This can be accomplished by providing gears attached to each of the screws interconnected by a chain.

As shown by FIGS. 1 and 3, the means used for guiding the creasing tool 60 with the help of the secondary plate is presented in the form of an arch-like fork engaging directly into the groove 70 of the tool. Obviously, this means is not exclusive and other guiding means can be easily adapted for the guiding arrangement of the secondary plate.

As the devices for the initial setting of the lateral position are hardly impaired by a particular weight, the shifting device, according to the present invention, contributes considerably to reducing the machine's downtime when switching the production from one box type to another. Depending on the number of interlocking apertures 211 available on top of the support 205 or on the number of seats on the periphery of the screw head 141, the operator has the possibility to set the amount of shift or offset to an eighth or a quarter or half of the slot width.

Although various minor modifications may be suggested by those versed in the art, it should be understood that I wish to embody within the scope of the patent granted hereon all such modifications as reasonably and properly come within the scope of my contribution to the art.

I claim:

1. In a device for shifting the lateral position of a tool in a slotting station situated within a machine processing sheet-like workpieces, said station having at least creasing tools and counterparts fitted in a corresponding fashion on a first vertical pair of parallel horizontal shafts arranged perpendicular to a conveying direction of the sheet-like workpieces through the machine, slotting tools and appropriate counterparts being fitted on another pair of shafts arranged downstream of said creasing tools in a fashion similar to the first-mentioned pair, as well as means for simultaneous sidewise positioning of all upper tools situated on a common line parallel to the conveying direction of the workpiece, every means consisting essentially of a master plate being held in a vertical position and having its plane oriented to extend parallel to the conveying direction by at least first and second crosswise shafts, said first shaft having a guiding function and the second shaft being provided with threading for shifting the plate laterally within said machine, said master plate being provided, on its periphery, with engagement means for laterally engaging the respective tools and guiding them on their respective shafts, the improvements comprising the engagement means including adjustment means mounted on the master plate for adjusting one of the tools, said adjustment means including a secondary plate and mechanical means for holding the secondary plate in a position extending parallel to the master plate and facilitating movement of the secondary plate and the tool relative to the master plate in a direction perpendicular to the plane of said master plate.

2. In a device according to claim 1, wherein the mechanical means includes a horizontal spindle being mounted on said vertical plate to extend orthogonally from a plane of said plate, said horizontal spindle having an axis and having an aperture extending transverse to said axis; a metal block permanently fitted on the secondary plate, said block and plate being provided with a first bore for slidably receiving said spindle, said block having a second bore extending transverse to the first bore, a vertical rod having a lower pin-shaped end engageable in said transverse aperture of the spindle, said rod adjacent said pin having an eccentric cylindrical portion and an upper part provided with a head, said upper part being held on the master plate by a support, said eccentric cylindrical portion being received in the second bore of the block so that rotation of the rod causes a translation motion of the block and secondary plate along said spindle.

3. In a device according to claim 2, wherein the head of the vertical rod is provided with an extension receiving a small bar, and means biasing the small bar in a vertical direction for engagement in openings provided in said support, said small bar having a knob allowing the raising of the bar against said spring to allow rotation of the rod to a new position, said small bar coacting with one of said apertures to interlock the head in a particular angular position with regard to the support and to interlock the lateral position of the secondary plate with regard to the master plate.

4. In a device according to claim wherein the mechanical means comprises a spindle being secured in one of said master plate and secondary plate to extend perpendicular to the plane of said one plate, at least one screw having a threaded portion and a smooth portion, said screw being mounted on one of said master and secondary plates for relative rotation therein and having the threaded portion threadably received in the other of said plates so that rotation of said screw causes a relative movement between the master and secondary plates.

5. In a device according to claim 4, wherein the spindle is fitted on said master plate and the smooth portion being held in said master plate with the threaded portion being threadably received in a bore in said secondary plate.

6. In a device according to claim 5, wherein the periphery of the screw head has a number of apertures circumferentially spaced therearound, a ball detent being mounted on the master plate adjacent the head of said screw for engaging said apertures to lock the screw in specific angular positions.

7. In a device according to claim wherein the mechanical means comprises a horizontal spindle mounted on the secondary plate to extend orthogonally to the plane thereof, at least one screw having a head with a smooth portion adjacent the head and a thread portion spaced from the head, said screw being mounted in a smooth bore in said secondary plate and held therein by the head and a shoulder spaced from the head, said master plate having a smooth aperture for receiving the spindle and a threaded aperture receiving the threaded part of the screw so that rotation of said screw causes the relative lateral movement of the secondary plate and the master plate along the axis of said spindle.

8. In a device according to claim 7, wherein the periphery of the screw head has a number of apertures spaced angularly therearound, and said device includes a ball detent mounted on said secondary plate adjacent the head of said screw, said ball detent engaging one of the apertures on the head to hold the screw in a particular angular position.

* * * * *